US007600973B2

(12) United States Patent
Tibbott et al.

(10) Patent No.: US 7,600,973 B2
(45) Date of Patent: Oct. 13, 2009

(54) BLADES FOR GAS TURBINE ENGINES

(75) Inventors: Ian Tibbott, Lichfield (GB); Charles F Connolly, Derby (GB)

(73) Assignee: Rolls-Royce plc, London (GB)

( * ) Notice: Subject to any disclaimer, the term of this patent is extended or adjusted under 35 U.S.C. 154(b) by 511 days.

(21) Appl. No.: 11/594,151

(22) Filed: Nov. 8, 2006

(65) Prior Publication Data

US 2009/0214328 A1 Aug. 27, 2009

(30) Foreign Application Priority Data

Nov. 18, 2005 (GB) ..... 0523469.5

(51) Int. Cl.
*F01D 5/08* (2006.01)

(52) U.S. Cl. ..... 416/97 R; 416/189

(58) Field of Classification Search ..... 415/115; 416/97 R, 189

See application file for complete search history.

(56) References Cited

U.S. PATENT DOCUMENTS 4,127,358 A * 11/1978 Parkes ..... 416/97 R
4,474,532 A * 10/1984 Pazder ..... 416/97 R
4,940,388 A * 7/1990 Lilleker et al. ..... 416/97 R
5,488,825 A 2/1996 Davis
2002/0172590 A1 11/2002 Sreekanth

FOREIGN PATENT DOCUMENTS

EP 0 894 946 A 2/1999

* cited by examiner

*Primary Examiner*—Ninh H Nguyen
(74) *Attorney, Agent, or Firm*—Jeffrey S. Melcher; Manelli Denison & Selter PLLC

(57) ABSTRACT

A blade for a gas turbine engine comprises an aerofoil having a root portion, a tip portion located radially outwardly of the root portion, and leading and trailing edges extending between the root portion and the tip portion. A shroud extends transversely from the tip portion of the aerofoil and the aerofoil defines interior cooling passages which extend between the root portion and the tip portion. The aerofoil includes a wall member adjacent the trailing edge and a support structure extending from the wall member to the shroud to support the shroud. The support structure permits a flow of cooling air from a cooling passage to the trailing edge at a region proximate the tip portion of the aerofoil. Optionally, the aerofoil also includes a flow disrupting arrangement.

20 Claims, 5 Drawing Sheets

BLADES FOR GAS TURBINE ENGINES

The present invention relates to blades for gas turbine engines, and in particular to turbine blades for use in gas turbine engines.

One of the means by which the efficiency of gas turbine engines can be maximised is to operate the turbine at the highest possible temperature. There maximum operating temperature is, however, limited by the temperatures which the various components of the gas turbine can withstand without failure.

Turbine blades, and particularly turbine blades used in high pressure turbine stages, are subject to very high temperatures during expansion of hot combustion gases from the combustion arrangement through the turbine. In order to prevent failure of the blades, it is necessary to cool them, for example using high pressure air from the compressor which has bypassed the combustion arrangement. The air from the compressor can be fed into cooling passages defined within the blades.

Such existing turbine blades can still be prone to premature failure, and it would therefore be desirable to provide an improved blade.

According to a first aspect of the present invention, there is provided a blade for a gas turbine engine, the blade comprising:

an aerofoil including a root portion, a tip portion located radially outwardly of the root portion, and leading and trailing edges extending between the root portion and the tip portion;

a shroud extending transversely from the tip portion of the aerofoil;

the aerofoil defining interior cooling passages which extend between the root portion and the tip portion, and including a wall member adjacent the trailing edge;

wherein the aerofoil includes a support structure extending from the wall member to the shroud to support the shroud, the support structure permitting a flow of cooling air from a cooling passage to the trailing edge at a region proximate the tip portion of the aerofoil.

Where the terms radial, axial and circumferential are used in this specification in relation to the blade, they refer to the orientation of the blade when mounted on a rotor of a gas turbine engine, for rotation thereon. Thus, the radial direction is along the length of the blade, the circumferential direction is transverse to the radial direction, in the direction of rotation of the blade, and the axial direction is along the axis of the gas turbine engine, perpendicular to the circumferential direction.

The aerofoil may include a radially extending cooling passage adjacent the trailing edge, and the support structure may permit the flow of cooling air from the cooling passage to a radially outer end of the trailing edge cooling passage.

The support structure may be arranged to reduce the pressure of the flow of cooling air as it flows from the cooling passage to the trailing edge. The support structure may be arranged to disrupt the flow of cooling air to thereby increase its turbulence as it flows from the cooling passage to the trailing edge. The increase in turbulence of the airflow may result in the aforesaid pressure reduction.

The support structure may comprise a plurality of support members which may extend from the wall member to the shroud, possibly in a generally radial direction. The support members may be formed integrally with the aerofoil. For example, where the aerofoil is formed by a casting process, the support members may be cast with the aerofoil.

The support members may extend along opposing inner surfaces of the aerofoil and said opposing inner surfaces may be defined by inner surfaces of pressure and suction surfaces of the aerofoil.

The support members on each of the opposing inner surfaces may be spaced apart and may be offset with respect to the support members on the opposing inner surface.

The combined cross-sectional area of the support members may be substantially equal to the cross-sectional area of the wall member from which the support members extend.

A radially outer end of the wall member may define a deflector arrangement for deflecting a proportion of cooling air from the cooling passage to provide the flow of cooling air to the trailing edge.

The deflector arrangement may include a deflector extending generally axially from a radially outer end of the wall member towards the cooling passage. The deflector may extend in a direction away from the trailing edge towards the leading edge.

The deflector arrangement may include a further deflector extending generally axially from the radially outer end of the wall member towards the trailing edge. The aerofoil may define a trailing edge interior cooling passage, and the further deflector may extend partly across the trailing edge interior cooling passage to prevent the flow of cooling air from the cooling passage moving in a radially inward direction along the trailing edge interior cooling passage.

The support members may extend from the deflector arrangement to the shroud.

The aerofoil may include a cooling air flow disrupting arrangement to disrupt the flow of cooling air from the cooling passage to the trailing edge. The flow disrupting arrangement may be arranged to increase the turbulence of the flow of cooling air, and thereby reduce its pressure, as it flows from the cooling passage to the trailing edge.

The flow disrupting arrangement may comprise a plurality of pin members which may extend between opposing inner surfaces of the aerofoil.

Alternatively or additionally, the flow disrupting arrangement may comprise a plurality of stud members which may extend from an inner surface of the aerofoil towards an opposing inner surface.

The blade may be a turbine blade.

According to a second aspect of the present invention, there is provided a gas turbine engine incorporating a blade according to the first aspect of the invention.

Embodiments of the present invention will now be described by way of example only and with reference to the accompanying drawings, in which:—

Figure 1:
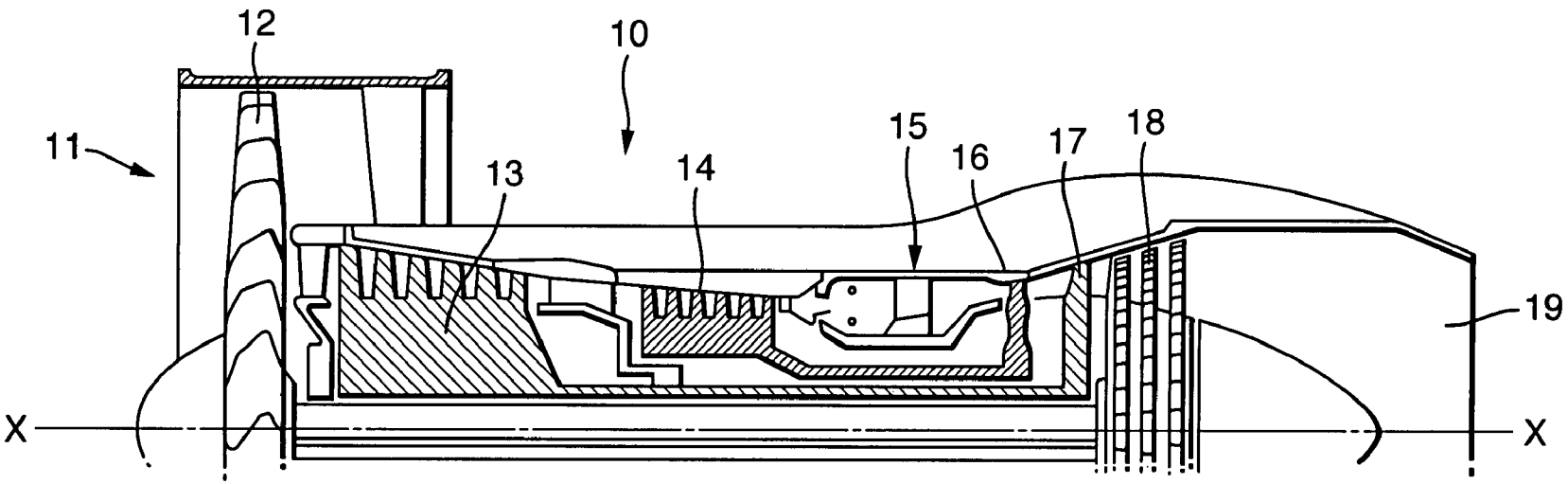
FIG. 1 is a diagrammatic cross-sectional view of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produces two air flows: a first air flow into the intermediate pressure compressor 13 and a second air flow which provides propulsive thrust. The intermediate pressure compressor 13 compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13, and the fan 12 by suitable interconnecting shafts.

Figure 2:
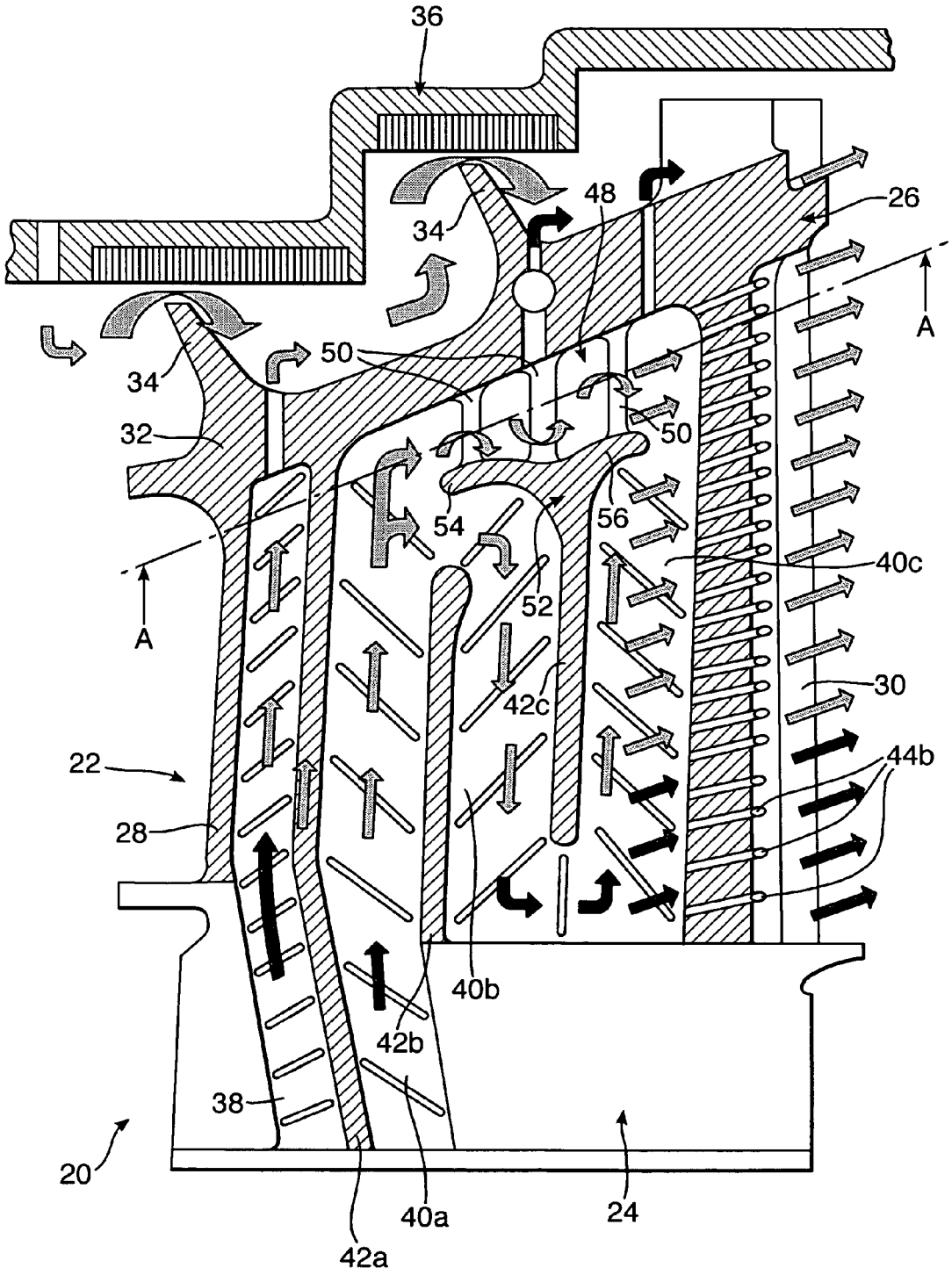
FIG. 2 is a diagrammatic cross-sectional view of a first embodiment of a blade according to the present invention.

Referring now to FIG. 2, there is shown a blade 20 according to the invention which is mountable on a rotor of a gas turbine engine, such as the gas turbine engine 10, to extend radially from the rotor. The blade 20 is desirably a turbine blade and is particularly suited for use in the high pressure turbine 16 where gas temperatures are at their highest. The blade 20 may, however, be used in other rotating components of the engine 10.

The blade 20 includes an aerofoil 22 having a root portion 24 and a tip portion 26 located radially outwardly of the root portion 24. The aerofoil 22 also has leading and trailing edges 28, 30 which extend between the root portion 24 and the tip portion 26. The blade 20 is mountable on the rotor via the root portion 24.

The blade 20 includes a shroud 32 which extends transversely from the tip portion 26 of the aerofoil 22, between the leading and trailing edges 28, 30. Sealing members 34 extend generally radially from the shroud 32 and are co-operable with a stationary shroud 36 forming part of the fixed engine structure.

The aerofoil 22 has a generally hollow structure and defines a leading edge cooling passage 38 which extends generally radially, adjacent to the leading edge 28. The leading edge cooling passage 38 receives cooling air from the compressor, normally the high pressure compressor 14, and thereby cools the leading edge 28 of the aerofoil 22, in use.

The aerofoil 22 also defines a plurality of further cooling passages, namely first and second cooling passages 40*a*, 40*b* and a trailing edge interior cooling passage 40*c*. The first, second and trailing edge cooling passages 40*a-c* are defined by wall members 42*a*, 42*b*, 42*c* which extend radially through the aerofoil 22 and which are formed integrally with the aerofoil 22, for example as part of a casting process.

The first, second and trailing edge cooling passages 40*a-c* also receive cooling air from the compressor, normally the high pressure compressor 14, for cooling the blade 20. In use, cooling air enters the first cooling passage 40*a*, via the root portion 24, and flows radially outwardly along the first cooling passage 40*a* towards the tip portion 26. A proportion of the cooling air is then directed around the second wall member 42*b* into the second cooling passage 40*b*, and the cooling air flows radially inwardly along the second cooling passage 40*b* towards the root portion 24. At the radially inner end of the second cooling passage 40*b*, the cooling air is directed by the third wall member 42*c*, which is located adjacent the trailing edge 30, into the trailing edge cooling passage 40*c*, and the cooling air flows radially outwardly along the trailing edge cooling passage 40*c* towards the tip portion 26.

As cooling air flows along the first, second and trailing edge cooling passages 40*a-c*, it passes from the interior of the aerofoil 22 through cooling holes 44*a* (see FIG. 3) defined in the pressure surface 46*a* (and possibly also the suction surface 46*b*) to provide film cooling of the aerofoil 22. The cooling air is finally bled from the interior of the aerofoil 22 through a plurality of cooling holes 44*b* defined in the trailing edge 30 to cool the trailing edge 30.

The aerofoil includes a support structure 48 which extends from the third wall member 42*c*, adjacent the trailing edge 30, to the shroud 32 to support the shroud 32. The support structure 48 permits a flow of cooling air from the first cooling passage 40*a* to the trailing edge 30 at a region proximate the tip portion 26 of the aerofoil 22.

In more detail, the support structure 48 includes a plurality of support members 50 which extend between the third wall member 42*c* and the shroud 32. The support members 50 are formed integrally with the aerofoil 22, for example as part of a casting process, and extend along opposing inner surfaces 52*a*, 52*b* defined respectively by the pressure and suction surfaces 46*a*, 46*b*. The support members 50 thus provide a load path between the third wall member 42*c* and the shroud 32 thereby reducing the centrifugal stresses to which the support structure 48 is subjected during circumferential rotation of the blade 20 in the gas turbine engine 10. In preferred embodiments of the invention, the combined cross-sectional area of the support members 50 is substantially equal to the cross-sectional area of the third wall member 42*c* from which they extend. There ensures that the same level of centrifugal force can be transmitted from the shroud 32 to the third wall member 42*c* as in prior art blades where the third wall member 42*c* extends to and supports the shroud 32.

Due to the fact that the support members 50 do not extend completely across the hollow interior of the aerofoil 22 like the first, second and third wall members 42*a-c*, they advantageously permit a proportion of the cooling air from the first cooling passage 40*a* to pass directly to the tip portion 26 of the trailing edge 30. Enhanced cooling of the trailing edge 30 at a region proximate the tip portion 26 is thus achieved.

Figure 3:
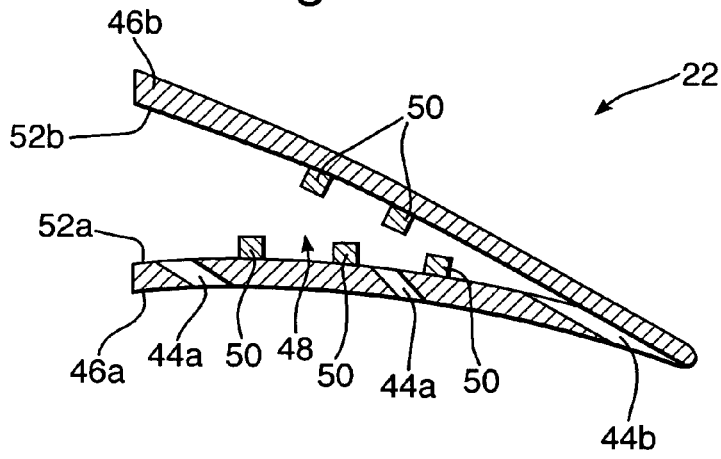
FIG. 3 is a diagrammatic cross-sectional view along the line A-A of FIG. 2.

As can be clearly seen in FIG. 3, the support members 50 are mounted on the opposing inner surfaces 52*a*, 52*b* in a spaced apart configuration. Furthermore, the support members 50 on each inner surface 52*a*, 52*b* are offset with respect to the support members 50 on the opposing inner surface 52*a*, 52*b*, to provide a staggered arrangement. This is advantageous as it increases the turbulence of the flow of cooling air to the trailing edge 30, thereby reducing its pressure. Providing a reduction in pressure of the flow of cooling air to the trailing edge 30 is important since it might otherwise be at a higher pressure than the cooling air which normally flows radially outwardly along the trailing edge cooling passage 40*c*, thus preventing the cooling air from flowing radially outwardly and resulting in a radially inward flow of cooling air along the trailing edge cooling passage 40*c*.

Referring again to FIG. 2, a radially outer end of the third wall member 42*c* defines a deflector arrangement 52 which deflects a proportion of the cooling air flowing radially outwardly along the first cooling passage 40*a* past the support members 50 to provide the flow of cooling air to the trailing edge 30. The deflector arrangement 50 extends across the hollow interior of the aerofoil 22, between the opposing inner surfaces 52*a*, 52*b*, and is part of the third wall member 42*c*.

In more detail, the deflector arrangement 52 includes a deflector 54 which extends from the radially outer end of the third wall member 42*c*. The deflector 54 extends in a generally axial direction away from the trailing edge 30 towards the leading edge 28. The deflector 54 extends from the end of the third wall member 42*c* across the second cooling passage 40*b* and towards the first cooling passage 40*a*. The deflector 54 has a slightly curved configuration, and its orientation and curvature are chosen so that desired proportions of the cooling air flowing radially outwardly along the first cooling passage 40*a* are directed into the second cooling passage 40*b* and towards the trailing edge 30.

The deflector arrangement 52 also includes a further deflector 56 which is of a similar configuration to the deflector 54, but which extends in the opposite direction to the deflector 54 generally axially from the outer end of the third wall member 42*c*. The further deflector 56 extends towards the trailing edge 30, partly across the trailing edge cooling passage 40*c*, and is operable to direct the flow of cooling air diverted from the first cooling passage 40*a* to the tip portion 26 of the trailing edge 30. It also assists with the prevention of a radially inward flow of the diverted cooling air along the trailing edge cooling passage 40*c* which, as already explained above, is undesirable.

As can be clearly seen in FIG. 2, the support members 50 extend from the deflector arrangement 52 to the shroud 32 to support the shroud 32 and to thereby transmit centrifugal forces from the shroud 32 into the third wall member 42*c*.

Figure 5:
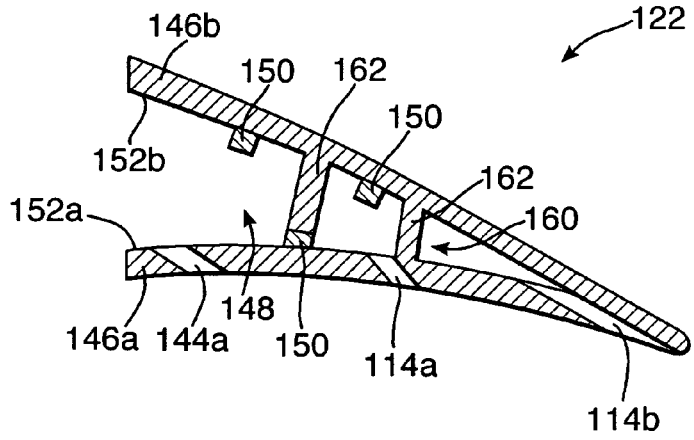
FIG. 5 is a diagrammatic cross-sectional view along the line B-B of FIG. 4.
Figure 4:
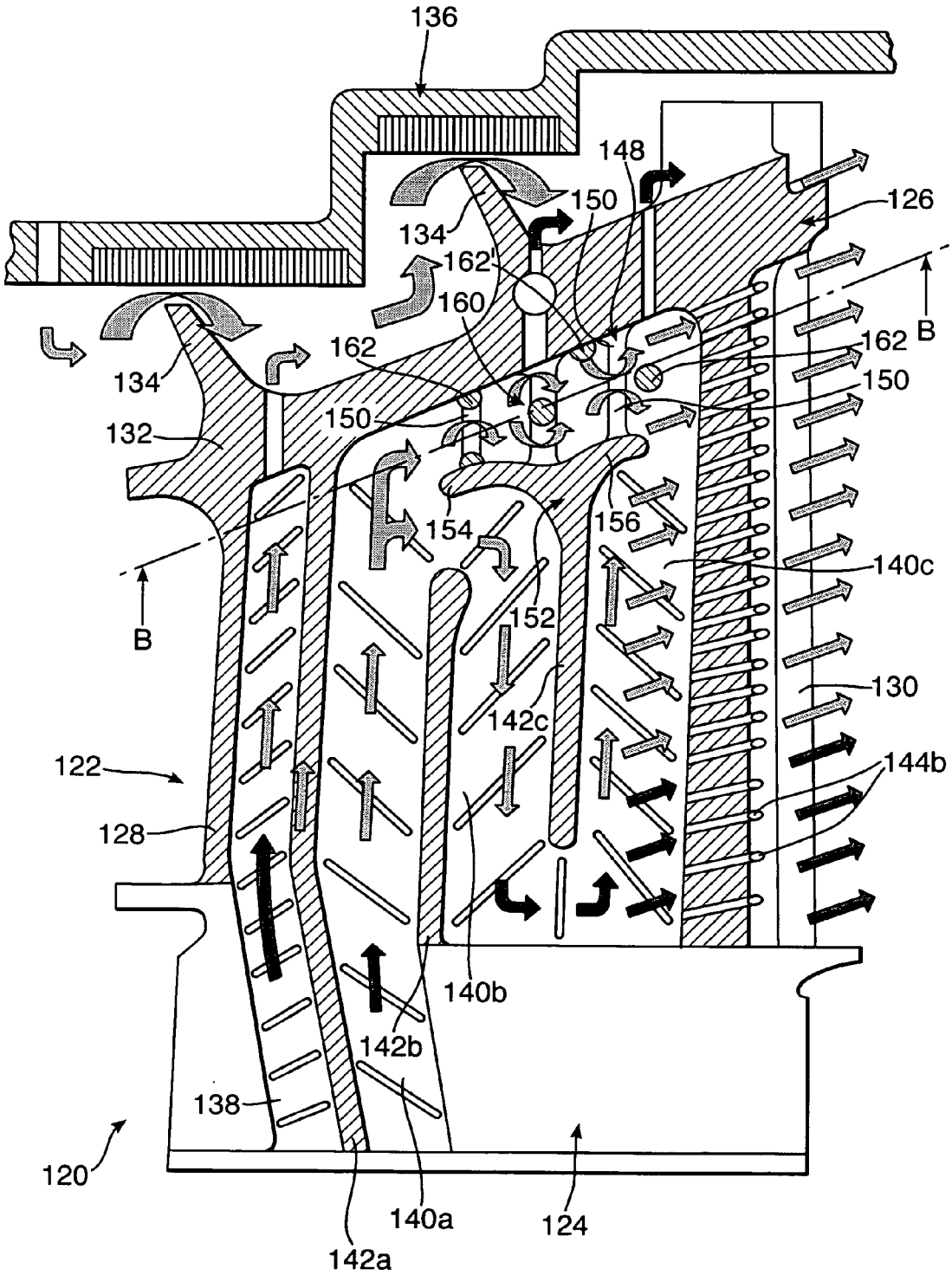
FIG. 4 is a diagrammatic cross-sectional view of a second embodiment of a blade according to the present invention.

FIGS. 4 and 5 show a second embodiment of a blade 120 according to the invention. The blade 120 is of generally the same construction and configuration as the blade 20 illustrated in FIGS. 2 and 3, and corresponding components are therefore designated by corresponding reference numerals, prefixed by the number '1'.

The aerofoil 122 additionally includes a cooling air flow disrupting arrangement 160 which is arranged to disrupt the cooling air as it flows from the first cooling passage 140*a* to the trailing edge 130. The air flow disrupting arrangement 160 increases the turbulence of the cooling air flow, and thereby causes an additional pressure reduction to that caused by the support members 150.

As best seen in FIG. 5, the air flow disrupting arrangement 160 comprises a plurality of pin members 162 which extend across the hollow interior of the aerofoil 122, between the opposing inner surfaces 152*a*, 152*b*. The pin members 162 are provided at different radial and axial positions within the hollow interior of the aerofoil 122 to maximise the disruption of the cooling air flow.

Figure 7:
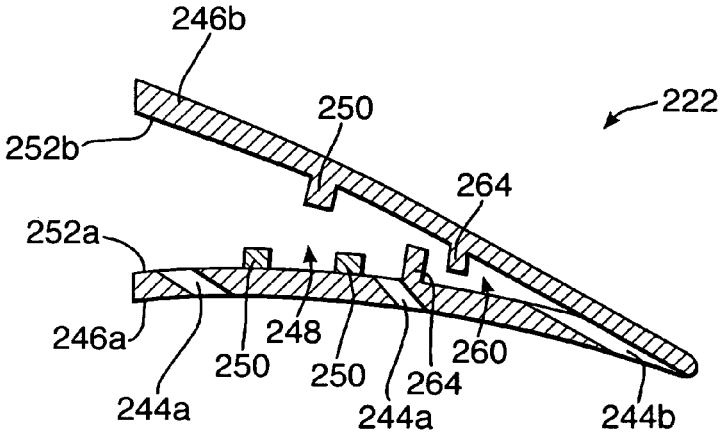
FIG. 7 is a diagrammatic cross-sectional view along the line C-C of FIG. 6.
Figure 6:
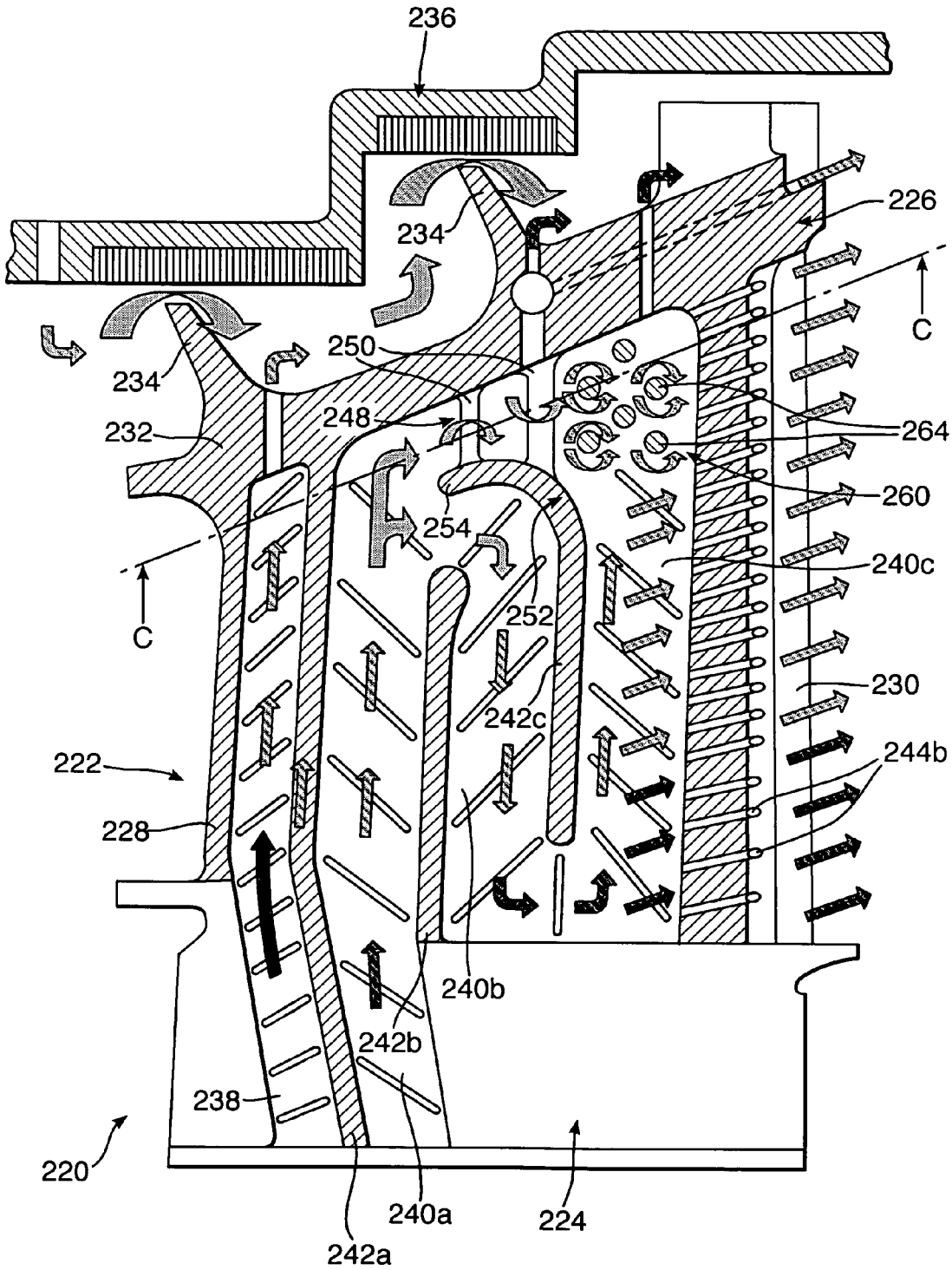
FIG. 6 is a diagrammatic cross-sectional view of a third embodiment of a blade according to the present invention.

Referring now of FIGS. 6 and 7, there is shown a third embodiment of a blade 220 according to the invention. The blade 220 is of generally the same construction and configuration as the blade 20 illustrated in FIGS. 2 and 3, and corresponding components are therefore designated by corresponding reference numerals, prefixed by the number '2'.

Like the aerofoil 122, the aerofoil 222 also includes a cooling air flow disrupting arrangement 260 which is arranged to disrupt the cooling air as it flows from the first cooling passage 240*a* to the trailing edge 230. The air flow disrupting arrangement 260 comprises a plurality of stud members 264 which extend from an inner surface 252*a*, 252*b*, partly across the hollow interior of the aerofoil 222 towards the opposing inner surface 252*a*, 252*b*. Again, the stud members 264 are provided at different radial and axial positions within the hollow interior of the aerofoil 222 to maximise the disruption of the cooling air flow.

In the embodiment of FIGS. 6 and 7, a large number of pin or stud members 264 are provided compared to the number of pin members 162 in the embodiment of FIGS. 4 and 5, and consequently there is a greater flow disruption resulting in increased turbulence and a greater pressure drop.

Consequently, in this third embodiment, the further deflector 56 has been omitted and the deflector arrangement 252 comprises only the deflector 254. The further deflector 56 is not needed as the pressure reduction caused by the plurality of stud members 264 is sufficient to prevent the flow of cooling air diverted from the first cooling passage 240*a* from flowing radially inwardly along the trailing edge cooling passage 240*c*.

There is thus described a blade 20, 120, 220 for a gas turbine engine 10 which offers improved cooling over known blades, particularly at the trailing edge 30, 130, 230 at the region proximate the tip portion 26, 126, 226 of the aerofoil 22, 122, 222.

Although embodiments of the invention have been described in the preceding paragraphs with reference to various examples, it should be appreciated that various modifications to the examples given may be made without departing from the scope of the present invention, as claimed. For example, the aerofoil 22, 122, 222 may define a greater number of cooling passages. The support members 50, 150, 250 may have a different cross-sectional shape and may be arranged in a different manner to that illustrated.

Whilst endeavouring in the foregoing specification to draw attention to those features of the invention believed to be of particular importance, it should be understood that the Applicant claims protection in respect of any patentable feature or combination of features hereinbefore referred to and/or shown in the drawings, whether or not particular emphasis has been placed thereon.

We claim:

1. A blade for a gas turbine engine, the blade comprising:

an aerofoil including a root portion, a tip portion located radially outwardly of the root portion, and leading and trailing edges extending between the root portion and the tip portion;

a shroud extending transversely from the tip portion of the aerofoil;

the aerofoil defining interior cooling passages which extend between the root portion and the tip portion, and including a wall member adjacent the trailing edge;

wherein the aerofoil includes a support structure extending from the wall member to the shroud to support the shroud, the support structure permitting a flow of cooling air from a cooling passage to the trailing edge at a region proximate the tip portion of the aerofoil.

2. A blade according to claim 1, wherein the support structure is arranged to reduce the pressure of the flow of cooling air as it flows from the cooling passage to the trailing edge.

3. A blade according to claim 1, wherein the support structure is arranged to disrupt the flow of cooling air to thereby increase its turbulence as it flows from the cooling passage to the trailing edge.

4. A blade according to claim 1, wherein the support structure comprises a plurality of support members extending from the wall member to the shroud.

5. A blade according to claim 4, wherein the support members are formed integrally with the aerofoil.

6. A blade according to claim 4, wherein the support members extend along opposing inner surfaces of the aerofoil.

7. A blade according to claim 6, wherein the support members on each of the opposing inner surfaces are spaced apart and are offset with respect to the support members on the opposing inner surface.

8. A blade according to claim 4, wherein the combined cross-sectional are of the support members is substantially equal to the cross-sectional area of the wall member from which the support members extend.

9. A blade according to claim 1, wherein a radially outer end of the wall member defines a deflector arrangement for deflecting a proportion of cooling air from the cooling passage to provide the flow of cooling air to the trailing edge.

10. A blade according to claim 9, wherein the deflector arrangement includes a deflector extending generally axially from a radially outer end of the wall member towards the cooling passage.

11. A blade according to claim 10, wherein the deflector extends in a direction away from the trailing edge towards the leading edge.

12. A blade according to claim 10, wherein the deflector arrangement includes a further deflector extending generally axially from the radially outer end of the wall member towards the trailing edge.

13. A blade according to claim 12, wherein the aerofoil defines a trailing edge interior cooling passage, and the further deflector extends partly across the trailing edge interior cooling passage to prevent the flow of cooling air from the cooling passage moving in a radially inward direction along the trailing edge interior cooling passage.

14. A blade according to claim 9, wherein the support members extend from the deflector arrangement to the shroud.

15. A blade according to claim 1, wherein the aerofoil includes a cooling air flow disrupting arrangement to disrupt the flow of cooling air from the cooling passage to the trailing edge.

16. A blade according to claim 15, wherein the air flow disrupting arrangement is arranged to increase the turbulence of the flow of cooling air, and thereby reduce its pressure, as it flows from the cooling passage to the trailing edge.

17. A blade according to claim 15, wherein the air flow disrupting arrangement comprises a plurality of pin members extending between opposing inner surfaces of the aerofoil.

18. A blade according to claim 15, wherein the air flow disrupting arrangement comprises a plurality of stud members extending from an inner surface of the aerofoil towards an opposing inner surface.

19. A blade according to claim 1, wherein the blade is a turbine blade.

20. A gas turbine engine incorporating a blade as defined in claim 1.

* * * * *